US006042664A

United States Patent [19]

Kozyrev et al.

[11] Patent Number: 6,042,664

[45] Date of Patent: Mar. 28, 2000

[54] AEROSOL-FORMING COMPOSITION FOR THE PURPOSE OF EXTINGUISHING FIRES AND METHOD FOR THE PREPARATION OF THIS COMPOSITION

[75] Inventors: Valeriy Nikolaevitch Kozyrev, Moscow; Valeriy Nilovitch Yemelyanov; Alexey Ivanovitch Sidorov, both of Moskovskaya oblast' ; Vladimir Andreevitch Andreev, Moscow, all of Russian Federation

[73] Assignee: R-Amtech International, Inc., Bellevue, Wash.

[21] Appl. No.: 09/119,531

[22] Filed: Jul. 21, 1998

Related U.S. Application Data

[62] Division of application No. 08/841,142, Apr. 24, 1997, Pat. No. 5,831,209.

[30] Foreign Application Priority Data

Apr. 30, 1996 [RU] Russian Federation ..... 96108059

[51] Int. Cl.[7] ..... C06B 21/00

[52] U.S. Cl. ..... 149/109.6; 292/5

[58] Field of Search ..... 149/109.6; 252/5

[56] References Cited

U.S. PATENT DOCUMENTS

| | | |
|---|---|---|
| 283,996 | 8/1883 | Garfield . |
| 633,807 | 9/1899 | Clayton . |
| 702,714 | 6/1902 | Febiger . |
| 3,608,641 | 9/1971 | Cottrell . |
| 4,251,699 | 2/1981 | Wiltgen, Jr. . |
| 4,386,979 | 6/1983 | Jackson, Jr. . |
| 5,423,384 | 6/1995 | Galbraith et al. . |
| 5,425,426 | 6/1995 | Baratov et al. . |
| 5,441,114 | 8/1995 | Spector et al. . |
| 5,593,485 | 1/1997 | Wang . |
| 5,610,359 | 3/1997 | Spector et al. . |
| 5,613,562 | 3/1997 | Galbraith et al. . |

FOREIGN PATENT DOCUMENTS

| | | |
|---|---|---|
| 0561035A1 | 9/1993 | European Pat. Off. . |
| 2060743 | 4/1994 | Russian Federation . |
| 1764213 | 5/1988 | U.S.S.R. . |
| 1821985 | 10/1988 | U.S.S.R. . |
| 1445739A1 | 12/1988 | U.S.S.R. . |
| 2046614 | 10/1998 | U.S.S.R. . |
| 2020971A | 11/1979 | United Kingdom . |
| 2020971B | 11/1979 | United Kingdom . |

*Primary Examiner*—Edward A. Miller

*Attorney, Agent, or Firm*—Rothwell, Figg, Ernst & Kurz, P.C.

[57] ABSTRACT

The present invention relates to a pyrotechnical, aerosol-forming composition for the purpose of extinguishing fires in confined spaces, containing potassium nitrate in a quantity of 67–72% by mass, phenolformaldehyde resin in a quantity of 8–12% by mass and dicyandiamide as the balance, wherein the particles of the potassium nitrate comprise a maximum average diameter of 25 $\mu$m, the particles of the phenolformaldehyde resin comprise a maximum average diameter of 100 $\mu$m and the particles of the dicyandiamide comprise a maximum average diameter of 15 $\mu$m.

A further object of the invention is a method for the preparation of the composition, which can be manufactured in conventional installations, by preparing a phenolformaldehyde solution using a mixture of ethyl alcohol with acetone in a ratio of 30–50:70–50 and by mixing and subsequently granulating during the drying process at 20–70° C. The drying process is preferably performed at 40° C. by means of circulating air.

4 Claims, No Drawings

AEROSOL-FORMING COMPOSITION FOR THE PURPOSE OF EXTINGUISHING FIRES AND METHOD FOR THE PREPARATION OF THIS COMPOSITION

This application is a division of 08,841,142 filed Apr. 24, 1997 U.S. Pat. No. 5,831,209.

The invention relates to fire-extinguishing technology, in particular the prevention and extinguishing of fires in confined spaces.

It is known, for the purpose of extinguishing a fire in a confined space, to create an atmosphere in this confined space which prevents combustion. As a fire-extinguishing agent inert thinning agents are used (carbon dioxide, nitrogen, argon, water vapour), volatile inhibitors, in particular halogen-containing agents, fire-extinguishing powders (A. N. Baratov, E. M Ivanov, "Löschen von Bränden in der chemischen und erdölverarbeitenden Industrie", Moskau, Chemie, 1979) ["Extinguishing fires in the chemical and petroleum processing industry", Moscow, Chemistry, 1979].

The known methods for the purpose of extinguishing fires in confined spaces using inert thinning agents cannot be used for extinguishing alkali and alkaline earth metals, some metal hydrides and compounds, which contain oxygen in their molecules.

In the development of systems for the purpose of extinguishing fires in confined spaces the possibilities are limited owing to the dimensions of the buildings which are to be protected (in the case of buildings with extremely large dimensions it is very difficult to be able to provide a sufficient quantity of gas in a given period of time). Furthermore the possibility of putting persons present in danger of suffocation must also be taken into consideration (therefore signal installations are necessary to indicate the deployment of the extinguishing procedure).

Extinguishing fires using halogen-containing compounds likewise has a series of disadvantages. These compositions can have a toxic effect on human beings, since, when a fire is being extinguished, the halogen-containing compounds form thermal decomposition products which have a large corrosive effect. Furthermore confined spaces which are particularly endangered by fire are normally protected by extremely large fire extinguishing systems for extinguishing fires in confined spaces, wherein halogen hydrocarbons are used. Owing to the international standards for the protection of the ozone layer in accordance with the Montreal protocol (1987) the use of the fluoro-hydrocarbons must be halved by the year 1995 and completely eradicated by the year 2000, since these substances comprise a great potential for damaging ozone.

Systems are known for the purpose of extinguishing fires in confined spaces, wherein halogen-containing hydrocarbons are used (for example GB-PS 2 020 971). A disadvantage of systems of this type is their harmful effect on the environment. Furthermore systems of this type comprise fairly large dimensions and a fairly large weight so that their efficiency is impaired when extinguishing fires in transport media, e.g. in aeroplanes.

A method is known for the purpose of preparing a fire-extinguishing agent, wherein when a charge of a pyrotechnical mass is burnt a mixture of solid particles and inert gases is formed (WO 92/17244). However, the high temperature of the combustive products results in increasing the average ambient temperature in the confined space, which produces a harmful effect on persons therein. Furthermore, when burning pyrotechnical solid combustion fuels, gaseous products (CO, $NH_3$, $H_2$, $CH_x$, and $NO_x$), in addition to the primary aerosol products having an extinguishing effect, develop from the incomplete combustion of the organic components, which leads to the environment being polluted by these products.

The composition in accordance with the invention achieves the object of providing an ecologically safe composition for the purpose of extinguishing fires in confined spaces.

An object of the invention is a pyrotechnical, aerosol-forming composition for the purpose of extinguishing fires in confined spaces, containing potassium nitrate in a quantity of 67–72% by mass, phenolformaldehyde resin in a quantity of 8–12% by mass, and dicyandiamide as the balance, wherein the particles of the potassium nitrate comprise a maximum average particle diameter of 25 $\mu$m and accordingly comprise a minimum specific surface area of 1500 $cm^2/g$, and the maximum average particle diameter of the phenolformaldehyde resin is 100 $\mu$m and the maximum average particle diameter of the dicyandiamide is 15 $\mu$m.

Preferably the composition in accordance with the invention also contains potassium bicarbonate ($KHCO_3$), potassium benzoate ($C_7H_5O_2K$) or potassium hexacyanoferrate $K_3[(FeCN)_6]$ having a maximum average particle diameter of potassium-containing material of 15 $\mu$m and accordingly having a minimum specific particle surface area of 500 $cm^2/g$. The composition contains (in % by mass):

| | |
|---|---|
| potassium nitrate | 67–72 |
| dicyandiamide | 9–16 |
| phenolformaldehyde resin | 8–12 |
| potassium benzoate, bicarbonate or hexacyanoferrate | 4–12 |

The object described is also achieved by virtue of the method for the preparation of the composition in accordance with the invention, which method comprises providing a solution of phenolformaldehyde resin, mixing the constituents, sieving out, granulating and drying, wherein for the preparation of the solution of the phenolformaldehyde resin a mixture of ethyl alcohol with acetone in a ratio of 30–50:70–50 is used, the powder-form constituents are mixed with the solution of the phenolformaldehyde resin by adding the solution in at least two equal portions until all constituents are distributed in a uniform manner in the whole mass, i.e. until a uniform and stable mass is obtained, the mixture is granulated simultaneously during drying at temperatures of 20–70° C. until a residual content of moisture and volatile constituents of not more than 1% is present and the granulated composition is sufficiently fluid when used.

The ratio and the dispersity of the constituents and the method for the preparation of the composition guarantee a more rapid and more complete combustion of the composition and a larger quantity of fine-grain particles and inert gases ($CO_2$, $N_2$, and $H_2O$ as vapour) in the aerosol, thus in turn guaranteeing that the composition extinguishes efficiently and thus producing during the extinguishing procedure a toxic level which is acceptable to human beings.

The use of fine-grain starting products of the powder-forming components (potassium nitrate, dicyandiamide, potassium benzoate, potassium bicarbonate, potassium hexacyanoferrate) and the use of phenolformaldehyde resin as a lacquer solution in ethyl alcohol/acetone mixture and the use of the method in accordance with the invention for the preparation of the composition render it possible to obtain a final mixture having the necessary technological properties and properties for use, and to reduce the duration of the preparation process and the risk of the said preparation process (the necessity for dangerous operations such as the circulation of air is obviated).

The composition in accordance with the invention can be prepared in standard pyrotechnical installations.

In table 1 formulations of the composition in accordance with the invention are illustrated in comparison to a known composition and the most important parameters of these compositions are also listed. It is evident from table 1 that the composition in accordance with the invention surpasses the known composition in all parameters listed.

In table 2 formulations of the composition in accordance with the invention (No. 11, 14, 16, 17, 18 and 21) are illustrated in comparison to compositions, wherein the quantity and/or the dispersity of the constituents are outside the range in accordance with the invention. It is evident from table 2 that the composition in accordance with the invention comprises a reduced toxic effect. Moreover, for the purpose of extinguishing fires, a lower concentration of extinguishing agent is required. Furthermore the composition in accordance with the invention guarantees a larger quantity of fine-grain particles and inert gases in the aerosol.

TABLE 1

| | Concentration of the components (% by mass) properites | | | | | | Nearest Prior Art |
|---|---|---|---|---|---|---|---|
| Components, properties of the mixture | 1 | 2 | 3 | 4 | 5 | 6 | WO 92/17244 |
| Potassium nitrate | 70 | 70 | 70 | 70 | 70 | 70 | 70 |
| Dicyandiamide | 12 | 12 | 12 | 9 | 9 | 9 | 19 |
| Iditol (Phenolformaldehyde resin) | — | — | — | — | — | — | 11 |
| Phenolformaldehyde resin as a lacquer (solid body) | 11 | 11 | 11 | 11 | 11 | 11 | — |
| Potassium bicarbonate | 7 | — | — | 9 | — | — | — |
| Potassium benzoate | — | 7 | — | — | 9 | — | — |
| Potassium hexacyanoferrate | — | — | 7 | — | — | 9 | — |
| Speed of fire (mm/s) | 2.1 | 2.5 | 2.3 | 1.8 | 2.3 | 2.1 | 1.5 |
| Specific pressure of the pressing process* | 1200 | 1200 | 1200 | 1400 | 1400 | 1400 | 2000 |
| Yield at disperse phase (Mol-%) | 56 | 64 | 62 | 53 | 58 | 57 | 48 |
| Fire-extinguishing concentration for Ethanol ($g/m^3$) | 40 | 35 | 35 | 45 | 40 | 40 | 50 |
| Concentration of toxic gases (Vol-%) | | | | | | | |
| $CO_2$ | 0 | 0 | 0 | 0 | 0 | 0 | 0.018 |
| $NH_3$ | 0.085 | 0.080 | 0.078 | 0.070 | 0.065 | 0.062 | 0.144 |

*for the purpose of attaining coupl. (Coupling) = 0,95 $kgf/cm^2$

TABLE 2

| | Concentration of component, % by mass, (average particle diameter, μm) | | | Toxic effect* | | Fire-extinguishing | |
|---|---|---|---|---|---|---|---|
| No. | $KNO_3$ | Phenolformal-dehyde resin | Gas-Aerosol-former | Dead, % | Paralysed, % | concentration $g/m^3$ | Level of discharge into the aerosol, % |
| 1 | 60 (~320) | 15 (~360) | 25 (~340) DCDA** | 79 | 100 | 48 | 76 |
| 2 | 67 (<25) | 10 (<100) | 23 (~340) DCDA | 0 | 4.2 | 36 | 88 |
| 3 | 50 (<25) | 8 (~360) | 32 (~340) DCDA | 100 | 100 | 42 | 80 |
| 4 | 67 (<25) | 18 (<100) | 15 (~340) DCDA | 0 | 58.3 | 38 | 84 |
| 5 | 60 (<25) | 8 (<100) | 32 (~340) DCDA | 100 | 100 | 40 | 84 |
| 6 | 70 (<25) | 5 (~360) | 25 (<15) DCDA | 0 | 12.5 | 36 | 86 |
| 7 | 70 (<25) | 15 (<100) | 15 (<15) DCDA | 0 | 4.2 | 34 | 90 |
| 8 | 70 (<25) | 18 (<100) | 12 (<15) DCDA | 0 | 16.7 | 36 | 90 |
| 9 | 60 (<25) | 15 (<100) | 25 (<15) DCDA | 79 | 79.2 | 42 | 80 |
| 10 | 58 (<25) | 5.5 (<100) | 36.5 (<15) DCDA | 79 | 100 | 56 | 78 |
| 11 | 69 (<25) | 12 (<100) | 17 (<15) DCDA | 0 | 4.2 | 26 | 97 |
| 12 | 65.5 (<25) | 14 (<100) | 20.5 (<15) DCDA | 0 | 17.4 | 28 | 95 |
| 13 | 68 (<25) | 13 (<100) | 19 (<15) DCDA | 0 | 4.2 | 26 | 96 |

TABLE 2-continued

| No. | Concentration of component, % by mass, (average particle diameter, μm) $KNO_3$ | Phenolformaldehyde resin | Gas-Aerosol-former | Toxic effect* Dead, % | Paralysed, % | Fire-extinguishing concentration g/m³ | Level of discharge into the aerosol, % |
|---|---|---|---|---|---|---|---|
| 14 | 70 (<25) | 11 (<100) | 19 (<15) DCDA | 0 | 0 | 24 | 99.3 |
| 15 | 54 (<25) | 12 (<100) | 34 (<15) DCDA | 100 | 100 | 120 | 68 |
| 16 | 70 (<25) | 11 (<100) | 12% (<15) DCDA + 7% (<15) KB | 0 | 0 | 27 | 97 |
| 18 | 69 (<25) | 8 (<100) | 11% (<15) DCDA 12% (<15) KHCF | 0 | 0 | 23 | 98 |
| 19 | 75 (<25) | 10 (<100) | 15% (<15) DCDA | 12.5 | 100 | 40 | 90 |
| 20 | 76 (<25) | 15 (<100) | 9% (<15) DCDA | 14.7 | 100 | 44 | 85 |
| 21 | 72 (<25) | 10 (<100) | 18% (<15) DCDA | 0 | 0 | 26 | 97 |

*The results are obtained from experiments conducted on white mice, which were subjected for a period of 15 minutes to a concentration of 60 g/m³ and were monitored thereafter for a period of 2 weeks.
**DCDA - dicyandiamide
KB - potassium benzoate
KBC - potassium bicarbonate
KHCF - potassium hexacyanoferrate

EXAMPLE 1

Extremely favourable results are obtained when using the composition in accordance with the invention and the method for the preparation thereof, if the following formulation (% by mass) is used:

| | |
|---|---|
| potassium nitrate with a specific particle surface area of 2000 cm²/g | 70 |
| dicyandiamide with an average particle size of 12 μm | 12 |
| phenolformaldehyde resin as 50% solution in a mixture of ethyl alcohol and acetone in the ratio of 50:50 (calculated as a solid body) | 11 |
| potassium benzoate with a particle surface area of 600 cm²/g | 7 |

The preground powder-form constituents (potassium nitrate, dicyandiamide, potassium benzoate) are poured into a mixer and mixed for 10 minutes. Then a phenolformaldehyde resin solution is added in three equal portions. The contents of the mixture are mixed for 5 minutes in each case after the addition of the corresponding portion of the phenolformaldehyde resin. The mixing is performed at a temperature of 40° C., with an opened cover. The mixture thus obtained is emptied from the mixer and passed through a sieve into a granulator whilst being continuously aerated with hot air at a temperature of 40° C. The predried granulate is laid in bands in layers 2–3 cm thick and is dried up to 1% for the purpose of removing any further moisture and volatile constituents. The total time spent mixing and granulating amounts to approximately 1 hour.

The mixture thus obtained can be dried still further in a pressed state, if the amount of moisture and volatile constituents exceeds 1%.

The pyrotechnical, aerosol-forming composition in accordance with the invention and the method for the preparation thereof render It possible to charge aerosol fire-extinguishing generators therewith and with the aid of said extinguishing generators to extinguish in an effective manner a fire of gaseous, liquid and solid combustible materials in stationary confined spaces, in transport media in rail and road traffic, on ocean-going and river ships, in aeroplanes, also including blow-by devices for example in aeroplane engines, and likewise to detect fires and to prevent the transition from a fire in specialist manufacturing installations to an explosion in the storage areas and in production plants which are endangered by fire and explosion.

We claim:

1. A method for the preparation of a pyrotechnical aerosol-forming composition for the purpose of extinguishing fires in confined spaces, said composition being formed from materials including phenolformaldehyde and powder-form constituents including potassium nitrate and dicyandiamide, said composition containing said potassium nitrate as particles in a quantity of about 67–72% by mass, phenolformaldehyde resin as particles in a quantity of about 8–12% by mass, and dicyandiamide as particles as a balance amount, wherein the particles of the potassium nitrate comprise a maximum average diameter of about 25 μm, the particles of the phenolformaldehyde resin comprise a maximum average diameter of about 100 μm and the particles of the dicyandiamide comprise a maximum average diameter of about 15 μm, in which method a solution of said phenolformaldehyde resin is prepared in a mixture of ethyl alcohol with acetone in a ratio of about 30–50:70–50, the powder-form constituents are mixed with the phenolformaldehyde resin solution while adding portions of the solution until a uniform distribution of constituents is obtained so as to form a resulting mixture, and the mixture is granulated simultaneously during drying at a temperature of about 20–70° C. until a concentration of not more than about 1% moisture and volatile constituents is present.

2. The method of claim 1 wherein said powder-form constituents include potassium bicarbonate, potassium benzoate or potassium hexacyanoferrate and said potassium bicarbonate, potassium benzoate or potassium hexacyanoferrate are present in said composition in a quantity of about 4–12% by mass as particles having a maximum average particle diameter of about 15 μm.

3. A method for the preparation of a pyrotechnical aerosol-forming composition for the purpose of extinguishing fires in confined spaces, said composition being formed from materials including phenolformaldehyde and powder-form constituents including potassium nitrate and dicyandiamide, said composition containing said potassium nitrate as particles in a quantity of about 67–72% by mass, phenolformaldehyde resin as particles in a quantity of about 8–12% by mass, and dicyandiamide as particles as a balance amount, wherein the particles of the potassium nitrate comprise a maximum average diameter of about 25 μm, the particles of the phenolformaldehyde resin comprise a maximum average diameter of about 100 μm and the particles of the dicyandiamide comprise a maximum average diameter of about 15 μm, in which method a first solution of the phenolformaldehyde resin is prepared in a mixture of ethyl alcohol with acetone in a ratio of about 30–50:70–50, an aqueous potassium nitrate second solution is added to the first solution in portions and under continuous agitation in a quantity such that in a resulting mixture, a volume ratio of the aqueous potassium nitrate second solution to the phenolformaldehyde resin first solution amounts to about 40–60:60–40, the powder-form constituents are added in portions and under continuous agitation into the mixture until the constituents are distributed in a substantially uniform manner, and the mixture is granulated simultaneously during a drying process at a temperature of about 20–70° C. until a concentration of not more than about 1% moisture and volatile components is present.

4. The method of claim 3 wherein said powder-form constituents include potassium bicarbonate, potassium benzoate or potassium hexacyanoferrate and said potassium bicarbonate, potassium benzoate or potassium hexacyanoferrate are present in said composition in a quantity of about 4–12% by mass as particles having a maximum average particle diameter of about 15 μm.

* * * * *